United States Patent [19]

Simion et al.

[11] Patent Number: 4,828,750

[45] Date of Patent: May 9, 1989

[54] FABRIC RINSE COMPOSITION TO REMOVE SURFACTANT RESIDUES

[75] Inventors: Frederick A. Simion, Hazlet; Linda D. Rhein, Somerville; John C. Blake-Haskins, Piscataway; Stephen W. Babulak, Kendall Pk.; Robert V. Cantore, Old Bridge, all of N.J.

[73] Assignee: Colgate-Polmolive Company, Piscataway, N.J.

[21] Appl. No.: 127,735

[22] Filed: Dec. 2, 1987

[51] Int. Cl.[4] ..... C11D 7/08; C23G 1/06

[52] U.S. Cl. ..... 252/142; 252/174.21; 252/174.22; 252/173; 134/41; 134/42

[58] Field of Search ..... 252/173, 174.21, 174.22, 252/142; 134/41, 42

[56] References Cited

U.S. PATENT DOCUMENTS

| | | | |
|---|---|---|---|
| 3,655,645 | 4/1972 | Jacques | 260/234 |
| 3,915,633 | 10/1975 | Ramachandran | 8/137 |
| 4,140,656 | 2/1979 | Mast | 252/545 |
| 4,206,070 | 6/1980 | Jones | 252/174.21 |
| 4,226,736 | 10/1980 | Bush et al. | 252/135 |
| 4,323,468 | 4/1982 | Grollier et al. | 252/174.17 |
| 4,443,270 | 4/1984 | Biard et al. | 252/174.21 |
| 4,501,680 | 2/1985 | Aszman et al. | 252/142 |

FOREIGN PATENT DOCUMENTS

| | | | |
|---|---|---|---|
| 1086178 | 9/1980 | Canada | 134/3.11 |
| 0139330 | 5/1985 | European Pat. Off. . | |
| 52-07711 | 1/1977 | Japan . | |

*Primary Examiner*—Paul Lieberman
*Assistant Examiner*—Ronald A. Krasnow
*Attorney, Agent, or Firm*—Richard J. Ancel; Murray M. Grill; Robert C. Sullivan

[57] ABSTRACT

A fabric rinse composition that removes residual soap and surfactant particularly anionic, left in the clothes during washing, which is disliked by consumers, consisting of low levels of a nonionic surfactant, low levels of an organic acid such as citric and/sodium citrate, and a major amount of water, in the form of a liquid or gel.

16 Claims, No Drawings

FABRIC RINSE COMPOSITION TO REMOVE SURFACTANT RESIDUES

FIELD OF THE INVENTION

This invention relates to an aqueous fabric rinse formulation for soap and surfactant residue removal consisting essentially of a minimal amount of a water soluble nonionic surfactant such as the polyethylene oxide—condensates of higher fatty alcohols, and a polysorbate containing 20 moles of ethylene oxide, a minimal amount of an organic acid having a pKa of 4.5 to 6.5 and/or a monovalent cation salt of the acid, and a major amount of water in an amount of about 84–98% by weight of the liquid formulation having a pH within the range of about 4.5–6.5. This product may be used as an after-rinse, at the completion of the laundering procedure, i.e. after the soap and/or anionic surfactant is rinsed with water from the fabrics, which include wool, cotton, dacron-cotton blends and any other blends which are absorbent. The present fabric rinse has the dual function of removing substantially all the residual soap and anionic surfactant residue, and conditioning the fabric to feel good against the skin and obviate possible skin irritation.

BACKGROUND AND PRIOR ART

Prior work has shown that large amounts of anionic surfactants and soaps are absorbed and retained by fabrics, such as wool, cotton, dacron-cotton mixture and other fabric mixtures, skin and other similar substrates during the washing process. These residual surfactants and soaps are difficult to rinse from wool and skin. The removal of said residues from the skin is addressed in a copending cleanser composition filed of even date. Consumers perceive these residues left on clothes as a negative, since they change the way fabrics feel, and can possibly be irritating. Accordingly, the presence of residual anionic surfactant on clothes being perceived in a negative way by the consumer, and as a potential source of skin irritation, there is clearly a need to develop a fabric rinse product addressing this problem. A unique combination of a buffered organic acid and a nonionic surfactant has been shown to be very effective at removing residual soap from said fabrics.

It has been found that this fabric rinse reduced the levels of residual anionic surfactant retained by wool fabric after washing, by 40–60% compared to a water rinse. The amount of surfactant rinsed out of the fabric by the prototype was significantly greater than formulas containing either ingredient alone.

A study using wool fabric and laurate soap demonstrated that $Ca^{++}$ and $Mg^{++}$ salts that produce water hardness increase surfactant deposition and absorption of the soap to the wool fabric, a keratin substrate. Hence, the water hardness increases the binding of the laurate soap to wool and, by analogy to skin, decreases the ability to wash the soap off the wool or skin, which binds the soap surfactant in a manner similarly to wool. It is the removal of this soap and/or synthetic anionic surfactant residue from the washed and water rinsed fabrics such as wool that is the subject matter of present invention.

Commercial facial detergent compositions containing soap and assorted mixtures of surfactants for use in the wash cycle of the laundering operation has addressed the problem of fabric softness in the prior art by adding softening agents to the detergent composition; or by separately adding the softening agent in the rinse cycle of the laundering operation. However, the removal of soap and/or surfactant residue after washing fabrics with soap has not been addressed in the prior art.

The use of a nonionic surfactant as one of the ingredients in a liquid detergent for cleaning fabrics is well known in the prior art as disclosed in U.S. Pat. Nos. 3,764,544 wherein is disclosed a spot remover for wearing apparel containing a nonionic surfactant; 3,959,163 wherein is disclosed a stain removing composition containing a bleaching compound and a nonionic surfactant; and 4,206,070 wherein is disclosed a binary surfactant system of nonionics.

U.S. Pat. No. 3,915,633 discloses an aqueous prewash aerosol spray soil release composition for use with a detergent or soap in a laundering operation, consisting of 1–20% by weight of an organic acid, i.e. citric acid, 2–30% by weight of an anionic or nonionic surfactant, water and an aerosol propellant. Canadian Pat. No. 1,086,178 discloses a liquid heavy duty laundry detergent composition containing 20–70% by weight of a soluble ethoxylated nonionic surfactant, 0.1–1.25% by weight of a polyacid, i.e. citric acid, and water/organic solvents, having a pH of 6–7.5.

Also disclosed in the prior art are mixtures of a nonionic surfactant and polyacrylate thickeners in aqueous dishwashing detergent formulations as disclosed in U.S. Pat. Nos. 3,950,260 and 4,226,736.

U.S. Pat. No. 4,501,680 discloses acidic liquid detergent compositions for cleaning ceramic tiles without eroding grout between them, comprising a minor proportion of glutaric acid and a lesser amount of phosphoric acid to provide a pH of 3–5, a minor amount of an ethoxylated fatty alcohol, a minor amount of a diethylene glycol monoalkyl ether, and a major amount of water.

U.S. Pat. No. 4,172,140 discloses an antimicrobial composition for inhibiting the growth of microorganisms in an aqueous fluid medium comprising as the active ingredients, an admixture of 1,3-dimethylol-5,5 dimethyl hydantoin and disodium ethylene diaminetetraacetate, for use in metal working fluids, cutting oil fluids, coolants, lubricants, and the like.

U.S. Pat. No. 4,612,137 discloses an anti-yellowing detergent composition comprising citric acid or salt and isocitric acid or salt and a surfactant, which may be anionic, nonionic, etc.

None of the aforesaid prior art disclose a fabric rinse to remove residual soap and/or synthetic anionic surfactants absorbed by the fabric during the washing process, consisting of a low level of a nonionic surfactant as the sole surfactant, a minor amount of an organic acid (or salt thereof) having a pKa from 4.5 to 6.5 to provide a pH of about 4.5 to 6.5, and a major amount of water, which may be thickened with polyethylene glycol - 150 distearate to a thick liquid or thickened with an acrylic acid polymer to form a gel, and preferably contains a preservative system.

SUMMARY OF THE INVENTION

It has been found that the soap and anionic surfactant residue retained on the fabric after washing with soap or surfactant can cause skin irritation and change the way fabrics feel, It has additionally been found that the soap residue can be effectively removed from the fabrics with the present novel rinse formulation consisting essentially of a minor amount of a water soluble nonionic surfactant, with the pH adjusted to about 4.5–6.5, using an organic acid having a pKa from 4.5 to 6.5 and a major amount of water, preferably deionized water. The novel fabric rinse is a clear product with viscosities ranging from watery solutions to thick gels, by the addition of a viscosity control agent selected from the group consisting of a diester of stearic acid and polyoxyethylene (PEG 150 distearate), and a polyacrylic acid resin (Carbopol 941). Compositions prepared with either thickener yield soft, smooth fabric, similar to the unthickened watery solution, without leaving a slimy or tacky feeling. The present novel composition functions as a fabric rinse which removes the absorbed soap and/or surfactant deposited thereon during the washing process.

Accordingly, a primary object of the present invention is to provide a liquid fabric rinse composition to remove soap and anionic surfactant residue from the washed fabric and thereby prevent possible irritation due to the soap or surfactant.

Another object of this invention is to provide a fabric rinse, to be used after washing with soap or surfactant and water, which results in a soft, smooth fabric feel.

Still another object of this invention is to provide a fabric rinse containing as the major ingredients, a nonionic surfactant, an organic acid, a major amount of water, and having a pH adjusted to about 4.5–6.5.

Another object of this invention is to provide a clear liquid afterwash fabric rinse or pre-fabric rinse with viscosities ranging from watery solutions to thick gels.

Another object of this invention is to provide a thickened or gelled fabric rinse containing a diester of stearic acid and polyoxyethylene or a polyacrylic acid resin as the thickening agent.

Another object of this invention is to provide a fabric rinse also containing a preservative system.

Additional objects, advantages and novel features of the invention will be set forth in part in the description which follows, and in part will become apparent upon examination of the following specification or may be learned by practice of this invention.

To achieve the foregoing and other objects in accordance with the present invention, as embodied and broadly described herein, the novel liquid fabric rinse composition to remove soap or anionic surfactant residue from the washed fabric in accordance with this invention, consists essentially of a major amount of water, preferably deionized water, about 0.25–6% by weight of a nonionic surfactant as the sole surfactant, about 0.05–5% by weight of an organic acid having a pKa from 4.5 to 6.5 or a monovalent cation salt of the acid or a mixture of said acid and salt, said composition having a pH of 4.5–6.5 and preferably 5–6.

More specifically, the clear liquid fabric rinse composition of the present invention, which removes soap and surfactant residue from the washed fabric, consists essentially of about 84–98% water; about 0.7–6% by weight of a water-soluble ethoxylated nonionic surfactant as the sole surfactant, selected from the group consisting of a polyethylene glycol ether condensate of a $C_8$-$C_{20}$ fatty alcohol or mixture of fatty alcohols with an average of 5 to 30 moles of ethylene oxide, and a polysorbate having an average of 20 moles of ethylene oxide; about 0.1–2% by weight of an organic acid, and/or sodium salt of the acid to adjust the pH of the composition to about 5–6; about 0.5–4% and preferably 0.6–2% by weight of a thickening agent selected from the group consisting of a diester of stearic acid and polyoxyethylene, and a polyacrylic acid resin; and a preservative system, which might comprise 1,3-dimethylol-5,5 dimethyl hydantoin and disodium ethylene diamine-tetraacetate in equal amounts, or Germaben II.

The after-wash fabric rinse of the present invention is preferably thickened to increase consumer acceptability by using the polyacrylic acid resin to form a gel, or the diester of stearic acid and polyoxyethylene to form a thick liquid.

The preservative systems in the present novel compositions effectively preserve the product against bacteria such as B. subtilis, and mold.

The formulations in accordance with present invention can also be used to remove soap from other surfaces that contain keratins, or similar proteins, such as hair.

DETAILED DESCRIPTION OF THE INVENTION

The major essential component in the liquid fabric rinse compositions of the present invention is about 84 to 98% by weight water, preferably deionized water. The water component is essential in the preparation of the present stable mild fabric rinse and functions as a solvent or vehicle for the other active ingredients in the composition, which are capable of being readily rinsed from the fabric.

Another essential ingredient in the present fabric rinse is a water-soluble nonionic surfactant, as the sole surfactant, preferably an ethoxylated nonionic surfactant selected from the group consisting of a polyethylene glycol ether condensate of a $C_8$-$C_{20}$ fatty alcohol or mixture of fatty alcohols with an average of 5–30 moles of ethylene oxide, and a polysorbate containing 20 moles ethylene oxide. Suitable fatty alcohols preferably contain 9 to 18 carbon atoms and most preferably 11 to 15 carbon atoms. Typical examples are lauryl, tridecyl, myristyl, cetyl, stearyl and oleyl alcohols or mixtures thereof, which may be condensed with about 5 to 20 moles ethylene oxide. Typical commercial products are the Tergitols obtainable from Union Carbide. More specifically, Tergitol 15-S-9 is a polyethylene glycol ether of a mixture of synthetic $C_{11-15}$ fatty alcohols with an average of 9 moles of ethylene oxide. Tergitol 25-L-7 is a polyethylene glycol ether of a mixture of synthetic $C_{12-15}$ fatty alcohols with an average of 7 moles of ethylene oxide.

The polysorbates are condensates of polyethylene oxide with fatty acid esters or mixtures of fatty acid esters or sorbitol and sorbitol anhydride. Fatty acid esters include laurate esters, stearate esters, palmitate esters or oleate esters. The fatty acid esters of sorbitol and sorbitol anhydride are preferably condensed with 20 moles of ethylene oxide. Typical products are Tweens obtainable from the Atlas Company, also known as Polysorbates. More specifically, Polysorbate 20 (Tween 20) is a mixture of laurate esters of sorbitol and sorbitol anhydrides, consisting predominately of the monoester, condensed with about 20 moles of ethylene oxide, commonly known as Polyoxyethylene (20) Sorbitan Monolaurate. Polysorbate 80 (Tween 80) is a mixture of oleate esters of sorbitol and sorbitol anhydrides, consisting predominantly of the monoester, condensed with about 20 moles of ethylene oxide, commonly known as Polyoxyethylene (20) sorbitan monooleate. The nonionic surfactant constitutes about 0.25–6%, preferably about 0.7–6%, and most preferably 0.5–2% by weight of the composition. The minimal amount of nonionic surfactant necessary for the aqueous rinse base to adequately remove bound soap is shown in Table I.

Wool fabric was used to quantitively compare the removal of residual soap from absorbent fabric with various rinse treatments. Wool was pretreated with a solution of radiolabelled soap, rinsed with hard water to remove loosely bound soap, and then treated with various rinse formulations. The amount of soap removed from the wool is determined by analyzing the rinse solutions and wool for radioactivity.

Rinse formulations were prepared containing 2.0% citric acid, and nonionic surfactant (Tergitol 15-S-9) varying in concentration from 0 to 2.0%. All solutions were adjusted to pH 5.0. The results shown in Table I indicate that in the absence of the nonionic surfactant, less than 20% of the residual soap is removed. The addition of even a small amount of surfactant increases the removal to almost 90%, and that a maximum in residue removal is reached at about 2.0%. These results show that nonionic surfactant is necessary for the rinse base to adequately remove bound soap, however the amount needed for almost complete removal is relatively low.

TABLE I

Effect of Surfactant Concentration of Residual Soap Removal by a Rinse Formula

| Treatment* | Percent Soap Removal |
|---|---|
| 0% Tergitol | 17.9 +/− 1.10 |
| 0.25% Tergitol | 87.0 +/− 2.34 |
| 0.50% Tergitol | 91.4 +/− 0.38 |
| 0.75% Tergitol | 89.5 +/− 0.80 |
| 1.00% Tergitol | 92.9 +/− 1.66 |
| 2.00% Tergitol | 96.4 +/− 0.31 |

*All treatment solutions contained 2% citric acid, adjusted to pH 5.0

Another essential ingredient in the present fabric rinse is an organic acid having a pKa value from 4.5 to 6.5, a monovalent cation salt of the acid, or a mixture of said acid and salt. The preferred acid is citric acid $C_3H_4(OH)(COOH)_3$, or a mixture of citric acid and a citrate salt made with a monovalent cation such as sodium or triethanolamine. The citric acid and/or citrate buffers soap and anionic detergent removal from the washed fabrics by coacting with the nonionic surfactant in removing soap and detergent residue bound to the fabric. Other suitable acids include acetic, succinic and glutaric acids. The organic acid constitutes about 0.05 to 5%, preferably 0.1 to 2% by weight of the composition. The minimal amount of organic acid required to buffer soap removal from the fabric is shown in Table II, using the pretreated wool fabric as defined above, and the amount of soap removed is similarly determined.

Rinse formulations were prepared containing 0.25% Tergitol, pH 5.0, and citric acid concentrations varying from 0 to 2%. The results are shown in Table II. As can be clearly seen, citric acid is also necessary for adequate residue removal. The rinse base removes only 66% of the residual soap, while addition of the smallest amount of citric acid (0.25%) increases the performance of the product to 88%. The results show a deviation from ideal behavior, in that there is an optimum concentration of citric acid for maximum performance near 0.5%, followed by a decrease in performance as the citric acid concentration continues to increase.

TABLE II

Effect of Organic Acid Concentration on Residual Soap Removal by a Rinse Formula

| Treatment* | Percent Soap Removal |
|---|---|
| 0% Citric Acid | 66.0 +/− 5.4 |
| 0.25% Citric Acid | 87.4 +/− 0.41 |
| 0.50% Citric Acid | 88.6 +/− 0.27 |
| 0.75% Citric Acid | 86.8 +/− 1.28 |
| 1.00% Citric Acid | 84.9 +/− 1.30 |
| 2.00% Citric Acid | 72.5 +/− 6.42 |

*All treatment solutions contained 0.25% Tergitol, adjusted to pH 5.0

The effectiveness of the unique combination of the buffered organic acid and a nonionic surfactant of present invention for the removal of residual surfactants from wool fabrics was determined using the following procedure: 100 m.g. wool test fabrics were treated with 20 mM solutions of radiolabelled sodium dodecyl sulfate (SLS) or linear dodecylbenzene sulfonate (LAS) for 1.5 hours, followed by a water rinse containing 100 ppm hardness (Ca:Mg 3:2) for 1.5 hours, followed by a rinse in the solutions containing either 100 ppm water; a buffered 2% sodium citrate to a pH of 6.0; 2.0% Tergitol, 15-S-9 adjusted to pH 6; or 2% sodium citrate and 2% Tergitol, for one hour. The wool fabric is filtered from the rinse treatment solutions and analyzed for radioactive surfactants. The total surfactant present in the fabric at the beginning of the rinse treatment was the sum of the surfactant in the solution and the fabric after the treatment, and the percent removal was calculated from the before and after levels. Radioactivity was measured with a Packard Tri-Carb 3375 liquid scintillation Spectrometer (Downers Grove, IL) using Biofluor scintillation cocktail (New England Nuclear, Boston, MA).

The results in Table III show that large amounts of surfactant are retained by the fabric after the first water rinse, and only small amounts of surfactant are removed by a second water rinse. Treatment with buffered citrate solution alone rinses out small amounts of surfactant, and Tergitol rinses out moderate amounts of SLS. When used in combination, however, large amounts of surfactant are rinsed from the fabric, and it is anticipated that a larger volume of rinse solution would result in even higher rinsing efficacy. The combination of these two materials is clearly synergistic.

These results show that the use of a combination of buffered citrate and Tergitol nonionic surfactant results in large reductions in the residual surfactant left in wool fabric after washing, and rinsing with water. Prior experiments have shown that other nonionic surfactants, such as Tween, are equally as effective as Tergitol at removing residual soap and surfactants from wool.

TABLE III

Rinsing of Residual Surfactants from Wool Fabric
Residual Surfactant in Wool ($\mu$M/g)[1]

| | Rinse: | | | | |
|---|---|---|---|---|---|
| Treatment | None | Water | Citr. | N.I. | Citr/N.I. |
| SLS | 211 | 192 | 186 | 143 | 79 |
| % Removal: | — | 9 | 12 | 32 | 63 |
| LAS | 171 | 168 | 166 | 133 | 96 |
| % Removal: | — | 2 | 3 | 22 | 44 |

The absorption of surfactant is defined as micromoles of surfactant sorbed per gram of substrate ($\mu$M/g)

A preferred additive in present fabric rinse is a thickening agent selected from the group consisting of a diester of stearic acid and polyoxyethylene (PEG 150 distearate) and a polyacrylic resin (such as Carbopol 941 or 940 or 1342). Carbopol 940 has rinsibility advantages over Carbopol 941. The Carbopol resins obtainable from the Goodrich Co., as a fluffy, dry powder are water soluble polymers of acrylic acid with a poly-functional agent, also known as polyacrylic acid resins by the CTFA name of Carbomers. Low concentrations of polyacrylic acid resins, about 0.1–4% and preferably about 0.1–2% by weight, effectively thickened the fabric rinse and form a gel fabric rinse which is clear, colorless and flows slowly when poured. However, Carbopol gels lose viscosity when exposed to UV light. Therefore, a UV stabilizer such as benzophenone should be added, especially if the product is sold in a clear bottle. The PEG-150 distearate, in amounts of 0.1–4% and preferably 2–4% by weight, increases the viscosity of the watery solution to a desired thickness, preferably to a thick liquid.

It has been found that the aforesaid two viscosity control agents provide viscosity control without attributing negative sensory feel to the treated fabric. It has additionally been found that said two thickening agents enable the formulation of this product to vary within a range of viscosities, from watery solutions to thick gels, while maintaining the clarity as well as the tactile sensations afforded by the unthickened formulations. Other suitable thickening agents capable of maintaining the clarity and the tactile sensations of the unthickened formulations may be also used. However, it has been found that the use of the thickening agents guar gums and cellulose resins are unacceptable from a sensory standpoint. The product containing guar gum resulted in a slimy feel on the fabric; and the product containing cellulose thickener resulted in a tacky feel on the fabric. Accordingly, the preferred thickening agents are PEG-150 distearate and the polyacrylic resins.

Another optional additive in the fabric rinse is a preservative system of 1,3-dimethylol-5,5 dimethyl hydantoin (DMDM hydantoin) and disodium ethylene diamine tetraacetate (EDTA), preferably in equal amounts of 0.3% by weight of each component. This preservative system effectively preserves the fabric rinse of present invention against mold and bacteria such as B. subtilis. An aqueous solution of a combination of DMDM hydantoin and EDTA as an antimicrobial composition for inhibiting growth of microorganisms is described in U.S. Pat. No. 4,172,140, the contents of which are herein incorporated by reference. This patent describes the use of a 0.25:1 to 20:1 ratio of DMDM hydantoin to EDTA as a preservative in metal working fluids, cutting oil fluids and other coolants. Another suitable preservative is Germaben II, a product of Sutton Laboratories, Inc., which comprises propylene glycol 50%, diazolidinyl urea 30%, methylparaben 11%, and propylparaben 3%. The Germaben II preservative does not reduce viscosity as much as the combination of EDTA and DMDM hydantoin preservative, so less Carbopol is needed to achieve the same viscosity.

The fabric rinse compositions of this invention also may contain minor amounts of conventional additional components to impart any desired characteristic, which are compatible with the fabric rinse formulation, and do not adversely affect its tactile properties and soap and surfactant removal properties. Suitable additives include fragrances, coloring agents and the like, in minimal amounts, not to exceed 5% by weight of the composition. These additives will replace some of the water in the formulation.

The pH of the clear liquid fabric rinse of present invention, which may be in the form of a watery solution, a thick liquid, or a gel, may vary within the range of 4.5 to 6.5 and preferably from 5 to 6. Using the pretreated wool substrate described in the previous experiments to ascertain the effect of surfactant concentration on rinse base effectiveness, i.e. residual soap and surfactant removal, a study of the effect of changing the rinse base pH was conducted. The surfactant and organic acid concentrations were held constant at 0.25% and 2% respectively.

The results shown in Table IV indicate that increasing the pH of the rinse formulation decreases the efficiency of soap removal only slightly, from about 90% at pH 4.5 to 83% at pH 6.5. These slight losses in product performance can be made up by optimization of the surfactant and organic acid concentrations.

TABLE IV

Effect of pH on Residual Soap Removal by a Rinse Formula

| Treatment* | Percent Soap Removal |
|---|---|
| pH 4.5 | 89.2 +/− 2.34 |
| pH 5.0 | 90.5 +/− 1.90 |
| pH 5.5 | 84.2 +/− 0.79 |
| pH 6.0 | 82.9 +/−0.27 |
| pH 6.5 | 83.1 +/− 4.41 |

*All treatment solutions contained 0.25% Tergitol and 2.0% citric acid

Using the pretreated wool substrate described in previous experiments, efficacy of the fabric rinse formulas in removing residual soap was evaluated. Formulas 'A' and 'C' contained 2.0% citric acid, were adjusted to pH 5.0, and had 1% and 6% tergitol respectively. Formula 'B' contained 300 ppm hard water only. The results of the study are shown in Table V, compared to the appropriate controls.

TABLE V

Efficacy of Fabric Rinse Formulas in Removing Residual Soap

| Treatment | Percent Soap Removal |
|---|---|
| Product A (1% Tergitol)* | 92.2 +/− 1.05 |
| Product B (Hard Water) | 13.7 +/− 0.77 |
| Product C (6% Tergitol)* | 98.1 +/− 0.30 |
| Control 1 (1% Tergitol, 2% Citric Acid) | 92.9 +/− 1.66 |
| Control 2 (Hard Water) | 14.9 +/− 0.66 |

*These formulas contained 2.0% citric acid, adjusted to pH 5.0

The results of the soap removal study agree with the formula composition, i.e. hard water ('B') removed the least amount of soap (13.7%), the 1% Tergitol formula ('A') removed 93%, and the 6% formula ('C') removed 98% of the residual soap from the wool keratin samples.

Evaluations further show that the optimum formula ingredient levels for removing residual soap with a pH 6.0 formula were 0.54% citric acid and 0.77% Tergitol 15-S-9, exhibiting a 99% soap removal.

The coaction of the nonionic surfactant, the citric acid and the pH provides a fabric rinse which optimizes residual soap and surfactant removal, and provides a desirable tactile sensation feel to the fabric. Test data has shown that compositions containing the combination of 0.5% citric acid and 0.5% nonionic surfactant removes about 91% soap, whereas citric acid compositions remove about 10% soap, 1% Tergitol (nonionic) removes about 77% soap, and the control (water only) removes 33.9% soap. Accordingly, the criticality of the ingredients and the specificity of each ingredient is necessary in the formulation of the present novel fabric rinse which is used as an after-rinse in the laundering of clothes.

The fabric rinse of the present invention are generally prepared by mixing the thickening agent, when used, with water until hydrated, then admixing the nonionic surfactant and the organic acid and/or the sodium salt thereof, such as the citric acid and/or sodium citrate, to form a uniform aqueous thickened solution, adding an aqueous solution of the preservative system to said aqueous solution with mixing, mixing until a homogeneous thick liquid or gel is formed, and adjusting the pH if necessary.

The fabric rinse compositions of present invention are clear, colorless, liquids which can be poured from any suitable container. The thin or watery liquids flow rapidly like water, when poured. The viscous or thick liquids flow slowly when poured. The gel also flows slowly when poured.

This product is used after washing fabrics with soap and/or surfactant and water. After the soap and surfactant is rinsed away, the fabric rinse of present invention is applied to the fabric by any suitable means. For example, the fabric rinse is added to the washing machine as an after-rinse at the completion of the laundering procedure. The fabric rinse can also be used as an after-rinse on hand washed fabrics.

The following examples merely illustrate the invention, but it is understood that the invention is not limited thereto. All amounts of various ingredients in the examples and elsewhere in the specification are by weight unless otherwise specified.

Examples 1 and 2
Fabric Rinse

| Ingredients | 1 % | 2 % |
|---|---|---|
| Tergitol 15-S-9 | 1 | 6 |
| Sodium citrate | 2.0 | 2.0 |
| Water | 97.0 | 92.0 |
| pH | 5 | 5 |

These products are prepared by adding the Tergitol and the sodium citrate to the water and mixing until a uniform solution is obtained.

Examples 1 and 2 were also used as a pre-fabric rinse to prevent or reduce the deposition of soap on the fabric during the laundering operation.

it was demonstrated that these formulations will reduce the deposition of up to 33% of soap on wool fabric.

Example 3
Gel Fabric Rinse

| Ingredient | % |
|---|---|
| Sterile Deionized Water | 95.9% |
| Tergitol 15-S-9 | 2.0% |
| Carbopol 941 | 1.0% |
| Citric Acid | 0.5% |
| DMDM Hydantoin | 0.3% |
| Ethylene diamine tetra acetic acid (EDTA) | 0.3% |
| | 100.0% |

The gel fabric rinse is a clear, colorless gel, which flows slowly when poured.

This product is prepared by dissolving Carbopol (Carbomer 941) in deionized water then adding Tergitol (Pareth 15-9) and citric acid and mixing until a uniform thickened aqueous solution is obtained. DMDM hydantoin (Glydent-Glyco) and EDTA are added to the solution and mixed until completely dissolved. A gel is formed as the pH is adjusted to 6.0 with sodium hydroxide.

This formulation can also be used as a pre-fabric rinse to reduce the deposition of soap on the fabric (wool was used as the test fabric).

Example 4
Gel Fabric Rinse

| | |
|---|---|
| 1.0% | Tergitol 15-S-9 |
| 0.6% | Carbopol 940 (thickener) |
| 0.3% | DMDM Hydantoin |
| 0.3% | EDTA |
| 0.1% | Citrate |
| 97.7% | Sterilized Deionized Water |
| pH adjusted to 6.0 with sodium hydroxide | |

This gel is prepared in accordance with the procedure set forth in Example 3.

This product exhibits the same tactile properties of smoothness, when applied as a non-gelled fabric rinse after washing with soap.

Example 5
Fabric Rinse

| Ingredients | % |
|---|---|
| Tergitol 15-S-9 | 2.0 |
| Sodium Citrate | 2.0 |
| Water | 96.0 |
| pH | 6.0 |

This product is prepared in accordance with the procedure set forth in Example 1. This product removed 63% sodium lauryl sulfate surfactant from a wool fabric sample, and 44% linear dodecyl benzene sulfonate surfactant from another sample of wool fabric.

The aforedescribed examples may be modified by the substitution of other nonionic surfactants for the Tergitol 15-S-9, such as Tween 20, Tween 80 and Neodol 25-7 (Pareth 25-7-Shell), without adversely affecting the efficacy of the compositions. Likewise, PEG-distearate may be substituted for the Carbopol thickening agent to form a thick liquid. Also, the citric acid or citrate may be replaced by glutaric, succinic or acetic acid and/or the sodium or triethanolamine salts thereof.

It is understood that the foregoing detailed description is given merely by way of illustration and that variations may be made therein without departing from the spirit of the invention.

We claim:

1. A clear liquid fabric rinse composition to remove soap and synthetic anionic surfactant residue from washed fabrics, consisting essentially of a major amount of about 84–98% by weight of water, about 0.25–6% by weight of a nonionic surfactant as the sole surfactant, about 0.05–5% by weight of an organic acid having a pKa from 4.5–6.5, or a monovalent cation salt of the acid or a mixture of acid and salt, said composition having a pH of 4.5–6.5, said nonionic surfactant being a water soluble ethoxylated nonionic surfactant selected from the group consisting of a polyglycol ether condensate of a $C_8$–$C_{20}$ fatty alcohol or mixture of fatty alcohols with an average of 5 to 30 moles of ethylene oxide, and a polysorbate containing 20 moles of ethylene oxide, preservative means, containing about 0.1–4% by weight of a thickening agent selected from the group consisting of a diester of stearic acid and polyoxyethylene, and a polyacrylic acid resin.

2. A composition according to claim 1, wherein said preservative means being of 1,3-dimethylol-5,5 dimethyl hydantoin and disodium ethylene diamine-tetraacetate, in equal amounts.

3. A composition according to claim 1, in the form of a clear gel containing about 0.1–2% by weight of a polyacrylic acid resin.

4. A composition according to claim 1, in the form of a thick liquid containing about 2–4% by weight of a diester of stearic acid and polyoxyethylene.

5. The composition according to claim 1, wherein the nonionic surfactant constitutes 0.7–6% by weight of the composition having a pH of 5–6.

6. The composition according to claim 1, wherein the nonionic surfactant is a polyethylene glycol ether of a mixture of synthetic $C_{11}$–$C_{15}$ fatty alcohols with an average of 9 moles of ethylene oxide.

7. The composition according to claim 5, wherein the nonionic surfactant is a polyethylene glycol ether of a mixture of synthetic $C_{11}$–$C_{15}$ fatty alcohols with an average of 7 moles of ethylene oxide.

8. The composition according to claim 2, wherein the organic acid and acid salt is citric acid and sodium citrate and consittutes about 0.1–2.0% by weight of the composition.

9. The composition according to claim 2, wherein, each of the ingredients int he preservative system constitutes about 0.3% by weight of the composition.

10. The composition according to claim 2, consisting of 2.0% by weight of nonionic surfactant, 2.0% by weight citric acid and having a pH of 6.

11. The composition according to claim 2, consisting of 1% nonionic surfactant, 2% sodium citric and having a pH of 5.

12. The composition according to claim 3, wherein the gel consists of 2% by weight nonionic surfactant, 1% by weight polyacrylic acid resin, 0.5% by weight citric acid, 0.3% by weight DMDM hydantoin, 0.3% by weight ethylene diamine tetra acetic acid and 95.9% by weight deionized water, having a pH of 6.

13. The composition according to claim 3, wherein the gel consists of 1% nonionic surfactant, 0.6% by weight polyacrylic acid resin, 0.1% by weight sodium citric, 0.3% by weight DMDM hydantoin, 0.3% by weight ethylene diamine tetraacetic acid and 97.7% by weight deionized water, having a pH of 6.

14. The composition of claim 1, in the form of a liquid fabric rinse to reduce the deposition of soap and detergent on the fabric.

15. The composition of claim 3, in the form of a gel fabric rinse for reducing the deposition of soap and detergent on the fabric.

16. The composition of claim 4, in the form of a thick liquid fabric rinse to reduce the deposition of soap and detergent on the fabric.

* * * * *